US006275654B1

(12) United States Patent
Hebert

(10) Patent No.: US 6,275,654 B1
(45) Date of Patent: Aug. 14, 2001

(54) CLEANING UNIT

(76) Inventor: E. Gerald Hebert, P.O. Box 6408-48, Kenner, LA (US) 70064

( * ) Notice: Subject to any disclaimer, the term of this patent is extended or adjusted under 35 U.S.C. 154(b) by 0 days.

(21) Appl. No.: 09/217,346

(22) Filed: Dec. 21, 1998

(51) Int. Cl.[7] ..... F24H 1/10
(52) U.S. Cl. ..... 392/465; 392/474; 134/111
(58) Field of Search ..... 392/465, 466, 392/471, 474, 498; 134/105, 108, 111

(56) References Cited

U.S. PATENT DOCUMENTS

| | | | | |
|---|---|---|---|---|
| 4,344,571 | | 8/1982 | Kundig | 239/130 |
| 4,552,162 | | 11/1985 | Finger | 134/57 R |
| 4,773,113 | | 9/1988 | Russell | 15/4 |
| 4,862,551 | * | 9/1989 | Martinez et al. | 15/321 |
| 5,004,156 | | 4/1991 | Montanier | 239/130 |
| 5,527,275 | * | 6/1996 | Ginsberg | 604/38 |
| 5,662,269 | | 9/1997 | Francis | 239/70 |

* cited by examiner

*Primary Examiner*—Sang Paik
*Assistant Examiner*—Thor Campbell
(74) *Attorney, Agent, or Firm*—Robert W. Strozier

(57) ABSTRACT

A cleaning unit is described which includes a heating unit and a recirculating pump assembly capable of supply a given fluid flow output at a given pressure at a dispenser head or wand. The recirculating flow is controlled by an unloader valve connected to the high pressure side of a pump, recirculating a portion of the flow to the low pressure side when the pressure in the high pressure side exceeds some set value. The unit utilizes an oversized pump so that an undersized motor can be used to improve durability and lifetime and low weight.

18 Claims, 2 Drawing Sheets

CLEANING UNIT

BACKGROUND OF THE INVENTION

1. Field of the Invention

The present invention relates to a pressure cleaning unit including a pressurized, recirculating pump subsystem, a heated fluid feed subsystem, an electrical control subsystem, and a fluid sprayer subsystem and to method for using the unit to clean surfaces.

More particularly, the present invention relates to a pressure cleaning unit including a pressurized, re-circulating pump subsystem where fluid is re-circulated by an unloader valve set to a pressure below a maximum output pressure of the pump, a heated fluid feed subsystem having unidirectional flow from the feed subsystem into the pump subsystem and having a thermocouple water temperature controller, an electrical control sub-system, and a fluid sprayer subsystem and to method for using the unit to clean surfaces.

2. Description of the Related Art

Cleaning units currently in the art are designed to operate in a non-pressurized environment. U.S. Pat. No. 4,552,162 discloses an electric combination cleaner which utilizes a float tank attached to a pump which then forwards water to heaters which in turn forwards water to the dispenser wand. Although water is or can be re-circulated to the float tank, the re-circulated fluid is not maintained under pressure.

Thus, there is a need in the art for an improved pressure cleaning unit that utilizes a pressurized, re-circulating pumping subsystem so that cleaning fluid is immediately available to at the desired pressure on demand.

SUMMARY OF THE INVENTION

The present invention provides an apparatus for cleaning surfaces of objects including a fluid supply and a heated fluid reservoir having a unidirectional inlet valve, an unidirectional outlet valve and a thermocouple connected to a temperature controller to maintain the fluid at or near a target or desired temperature. The apparatus also includes a pressurized, re-circulating pumping subsystem having a positive displacement pump, a low pressure side, feed assembly connected to a low pressure pump inlet and a high pressure side outlet assembly connected to a high pressure pump outlet. The inlet assembly includes a low pressure, side pressure relief valve and a re-circulation return line. The outlet assembly includes a high pressure side, pressure relief valve, a pressure oscillation damper or anti-hammer device and an unloader valve. An unloader valve over-pressure line is connected to the re-circulation return line of the inlet assembly, while a normal pressure line is connected at its distal end to a fluid dispenser, sprayer or wand. The wand can also include a venturi soap supply device or a separate soap line connected to a soap metering device where the soap supplied mixes with the fluid flow from the pump resulting in the dispensing of a soap solution.

The present invention also relates to a method for cleaning surfaces including directing a stream of cleaning fluid onto a surface to be cleaned using a cleaning device of the present invention.

The present invention further relates to a method for producing a fluid stream including supplying a fluid to a reservoir through a one-way valve where the fluid is heated to a desired temperature. Forwarding the heated fluid through a one-way valve to a pressurized, re-circulating pump assembly including a positive displacement pump having a low pressure side, supply line which includes a return line and a low pressure side relief valve, and a high pressure side, outlet line which includes a high pressure side relief valve, a pressure oscillation damper or anti-hammer device, and an unloader valve having an overpressure line connected to the return line and a normal pressure line connected to a fluid dispensing head. Producing a fluid stream by opening a valve in the dispensing head which can be directed towards a surface to be cleaned.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1:
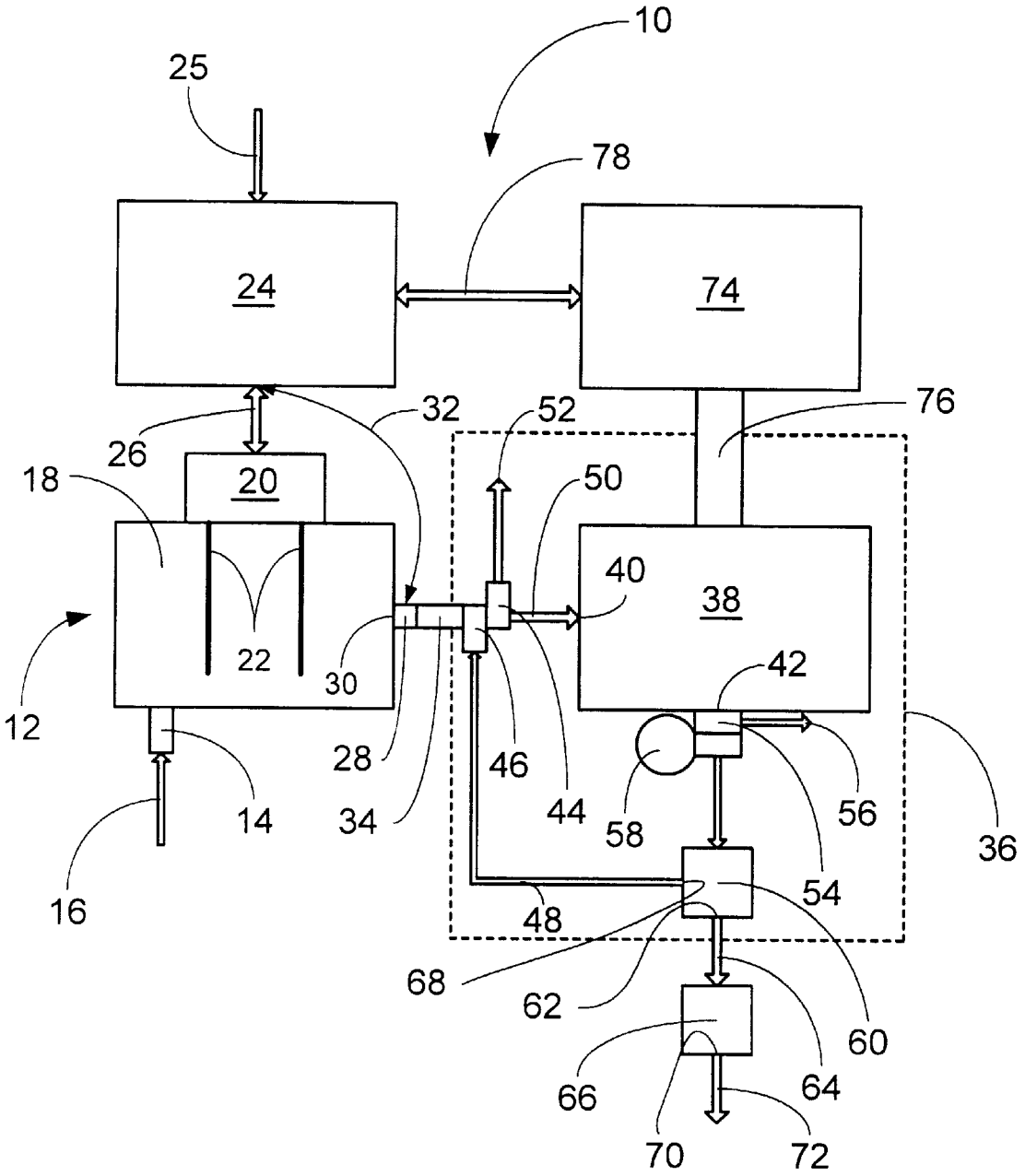
FIG. 1 is a block diagram of a cleaning unit of the present invention.

The inventor has found that an improved pressure cleaning apparatus can be constructed that allows for better on-demand operation by incorporating a pressurized, recirculating pump assembly that maintains a constant readily accessible supply of fluid pressure for operation of a sprayer head or wand. The pressurized, re-circulating pump assembly utilizes low pressure side and high pressure side relief valves to protect the pump and the lines to and from the pump. Re-circulation is accomplished by an unloader valve connected to the high pressure side of the pump which opens when the pressure exceeds some pre-set value directing some of the fluid pressure to the low pressure side of the pump. The re-circulation pressure due to the operation of the unloader device results in a re-circulation pressure that is below a pressure that would tend to damage the low pressure side pump seals or any component associated with the low pressure side feed assembly.

In addition to the pressurized re-circulation of pump output, the present apparatus also includes a temperature controlled fluid heating or cooling device with unidirectional or on-way input and output valves. The device includes a fluid reservoir with at least one heating element. The fluid heating device is designed to provide to the re-circulating pump assembly a supply of fluid at a specified temperature. The temperature of the fluid can be colder or hotter than the ambient temperature.

However, preferably the fluid temperature ranges between ambient temperature and the temperature of the super-heated fluid. Thus, if the fluid is water, the water temperature can be maintained below ambient temperatures by cooling, at ambient temperature by neither cooling nor heating and above ambient temperatures by heating. Because the apparatus is pressurized and incorporates a re-circulating pressurized pump assembly, the apparatus can also provide steam and super-heated steam to the wand by simply increasing the heating rate of the heating elements in the heating device.

The apparatus of the present invention are preferably used in environments which can be explosive so the apparatus is designed to explosion proof specifications. Thus, all electrical connections and electric circuitry are contained in explosion proof housings, i.e., the wiring is contained within air-tight, metal tubing or protected flex tubing and connection are either metal fittings or packed couplings or fitting.

The present invention can use any type of positive displacement pump, but duplex, triplex and quadraplex positive displacement pump are preferred, with triplex and quadraplex pumps being particularly preferred. The pump is driven by an electric motor; however, other power systems can also be used such as a steam power unit, magnetic power unit, or other power unit or motors known in the art. The drive mechanism coupling the motor or other power unit to the pump can be any drive mechanism known in the art including, belt or chain drives, direct drives, gear box drives or clutch assembly drives with belt drives being preferred.

To maximize lifetime and durability and minimize down time, the inventors have found that the pump should be oversized which allows for the motor to be undersized. Preferably, the pump should be oversized, i.e., have a maximum capacity, about 10 to 100% greater than a desired operating flow output and pressure of the system. Thus, if the desired operating pressure is about 3200 psi which is designed to deliver about six gallons per minute of fluid through a standard wand orifice at 3000 psi at the wand orifice, then the pump should have a maximum pressure capacity between about 3540 and about 6400 psi.

Because the pump is operating at below maximum capacity, the motor can be undersized. Thus, in a preferred configuration a 4500 psi rated triplex pump is driven by a 15 hp electric motor. This configuration would not be possible if the pump was being operated at or near maximum capacity because the motor would be incapable of supplying the necessary power to the pump. This combination of an oversized pump and an undersized motor allows the unit to have a lower weight, higher durability and longer life. In fact, field tests indicate that the apparatus of the present invention have significantly longer lifetimes than competitive apparatus.

The apparatus of the present invention uses a standard wand or spray assembly through which the about six gallon per minute flow exits and is directed to a surface to be cleaned. The wand can include a device to supply a soap stream to the wand so that the output stream includes a detergent. This device can be a separate soap feed line from a metered pump or the soap can be sucked into the fluid flow using a venturi soap supply device.

Generally, the fluid is water and the temperature is between about ambient and 180° F., preferably between about 70° F. and about 180° F. and particularly between about 90° F. and about 180° F. Typically, the unit delivers fluid at about 165° F.

The unit so includes an electric control unit connected to a supply of electric energy by a long cable so that the unit can be used at distances up to 100 ft or more from the supply unit. The electric control unit includes a master on/off switch, fuse or breaker supply circuits for the heating unit and pump motor, and control circuitry for monitoring the fluid temperature in the reservoir. The circuitry is all preferably contained within a standard explosive proof housing.

Although any voltage capable of supply the needed current to the heaters, pump motor and sensing devices can be used, the preferred voltage for the heaters and pump motor is a 440 V, 3-phase voltage supply. The preferred voltage supply for the sensor devices is 110V, single phase so that the control unit has appropriate step-down transform to lower the voltage from 440 to 110. Preferably, the control unit uses a plurality of fuses in the heater and pump motor supply circuits to protect against shorts or other electrical circuit disruptions. Of course, breakers can be used as well. The unit also has a master breaker that will cut off all power to the unit.

In addition to the temperature sensor on the heater unit, the control unit can also be connected to flow sensors in the low and high pressure relief valves. The control unit can then include circuitry that can shut off electricity to the heaters and/or motor if the flow sensors detect flow in the relief lines. Preferably, the circuitry will not activate shut down unless flow through the relief valve is sustained for some period of time preferably about 0 to a desired period of sustained relief flow, preferably about 1 to about 60 seconds, and particularly about 5 to about 15 seconds.

Suitable fluid for use in the apparatus of the present invention, include without limitation, water, aqueous solutions, cleaning solutions, de-greasing solutions, brine solutions (salt water), or mixture or combinations thereof. Water, aqueous solutions, cleaning solutions, or mixtures or combination thereof are preferred, with water being especially preferred. Preferably, any detergent or de-greasers are added at the wand to protect the integrity of the heating unit and pump assembly. Of course, when a corrosive solution such as salt water is used, the heaters and all internal component must be selected to operate under such corrosive conditions.

Referring now to FIG. 1, a block diagram of a cleaning unit of this invention is shown generally 10. The unit 10 includes a heated fluid unit 12 having an one-way or unidirectional inlet valve 14 for receiving a fluid feed 16 from a fluid supply (not shown) and preventing fluid from flowing back out of the valve 14. The unit 12 includes a fluid reservoir 18 and a heating unit 20. The heating unit 20 includes at least one heating element 22 contained within the reservoir 18. The heating unit 20 is in electrical communication with an electric control unit 24 via electrical wiring 26, preferably the wiring 26 is explosion proof wiring.

The electric control unit 24 is connected to an outside power supply (not shown) by a cable 25. Preferably, the heating unit 20 and the elements 22 are based on a 440 V, 3-phase power supply, but can be based on other voltages and phases. The heating unit 20 includes at least one heating element 22 of sufficient power output to heat the fluid to a desired final temperature. Preferably, the heating unit 20 includes at least two heating elements so that the heating load can be shared and also to allow the unit to operate if one of the elements fails.

Although the heating unit 20 includes a thermostat (not shown) for cycling current to the elements 22, the heating unit 20 does not provide sufficient fine control over a fluid temperature in the reservoir 18. Fine temperature control is achieved using a temperature sensor 28, preferably a thermocouple, mounted at an exit port 30 of the reservoir 18. The temperature sensor 28 is in electrical communication with the electric control unit 24 which includes a temperature control unit (not shown) via wires 32. The wires 32 are, preferably contained within a stainless steel conduit for explosion proofing.

Just downstream of the temperature sensor 28 is a second one-way or uni-directional valve 34 which permits fluid to flow out of the reservoir 18 and prevents fluid from flowing back into the reservoir 18 from all downstream components. The unit 10 can also include a temperature gauge (not shown) in-line downstream from the sensor 28. The electric unit 24 is connected to an external power source by an explosion proof electric cable not shown. Because the unit 10 is designed to operate at some distance from the power source, the electric cable is generally between about 50 to 300 ft long, with lengths between about 75 and 125 ft being preferred. The electric cable can be mounted on a wind-up reel or simply coiled onto a coiling platform associated with the unit (see FIG. 2). After leaving the reservoir 18, the fluid flows into a pump assembly 36. The pump assembly 36 includes a pump 38 having a low pressure side, inlet 40 and a high pressure side, outlet 42. Upstream from the inlet 40 and connected to the inlet 40 is a low pressure side, relief valve 44 and a re-circulation connection 46, preferably a T-junction, into which a re-circulation flow 48 enters the low pressure side, inlet fluid feed 50. The connection 46 can also include a one-way or unidirectional flow valve allowing flow into the connection 46, but not out of the connection 46. Of course, the flow 48 is contained within an suitable conduit or hose. As this the heated reservoir 18, the low pressure, side feed assembly can also include an in-line pressure gauge.

The relief valve 44 supports a relief flow 52 that exists only if a fluid pressure in the low pressure side, inlet fluid feed 50 exceeds a desired threshold value. This threshold value is generally less than a pressure that would harm the low pressure side pump seals. For a recirculating flow pressure of between about 50 and about 400 psi, the relief valve is generally set for about 450 psi. The preferred re-circulation flow pressure is between about 100 and about 300 psi and particularly between about 100 and about 200 psi. Of course, if the re-circulation flow pressure is between about 100 and about 200 psi, then the relief valve can be set at a pressure below 450 psi and the unit would still function properly. Moreover, the exact relief valve pressure is a pure matter of convenience.

The pump 38 is preferably a triplex, positive displacement pump running on a 440 V, 3-phase power supply and capable of a maximum pressure rating of about 4000 psi. Connected to the high pressure outlet 42 of the pump 38 is a high pressure side, relief valve 54 which supports a relief flow 56 when a high pressure exceeds some desired value. Under normal operating conditions of about 3200 psi, the high pressure cut off is set at about 3500 psi.

Generally, the high pressure cut off value of the high pressure relief valve is set about 10% above the desired operating pressure of the unit. Of course, the high pressure relief valve 54 is designed to protect the high pressure side pump seals and all downstream components from damage. Therefore, the pressure cut off can be set at any valve above the desired operating pressure and below a pressure of the lowest rated component downstream of the relief valve 54. Again, as with the low pressure feed assembly, the high pressure assembly can also include an in-line pressure gauge.

The desired operating pressure is generally set so that a wand pressure will give rise to a desired output flow rate. If the wand pressure is about 3000 psi and the desired output flow rate is about 6 gallon/minute, then the desired pump operating pressure is about 3200 psi if the pump and the wand are connected by ⅜" hosing. Of course, one of ordinary skill in the art will recognize that the unit can be adjusted to support other pressures and flow rates.

Connected to the high pressure relief valve is a damper 58 which in turn is connected to an unloader valve 60. The unloader valve 60 has a normal outlet 62 through which an output flow 64 flows through a pressure hose to a wand 66 and a over-pressure outlet 68 through which the re-circulation flow 48 flows through a suitable conduit into the valve 46 associated with the low pressure side feed line 50. The damper or anti-hammer device 58 is designed to reduce or eliminate pressure oscillations due to the operation of the unloader valve 60 as flow is diverted to the recycle flow 48. The wand 6 as an orifice 70 through which an fluid flow 72 exits the unit 10 and is directed and impinges on a surface to be cleaned.

The pump 38 is operably connected to an electric motor 74 via a drive train 76. The preferred drive train 76 is belt driven. However, as stated previously, the drive train can be any drive train known in the art to couple a positive displacement pump to an electric motor or other suitable power system. The electric motor 74 is preferably about a 15 to about a 20 hp motor operating on 440 V, 3-phase power delivered by the electric unit 24 via explosion proof wiring 78. Of course, regular wiring can be used in non-explosion environments.

Figure 2:
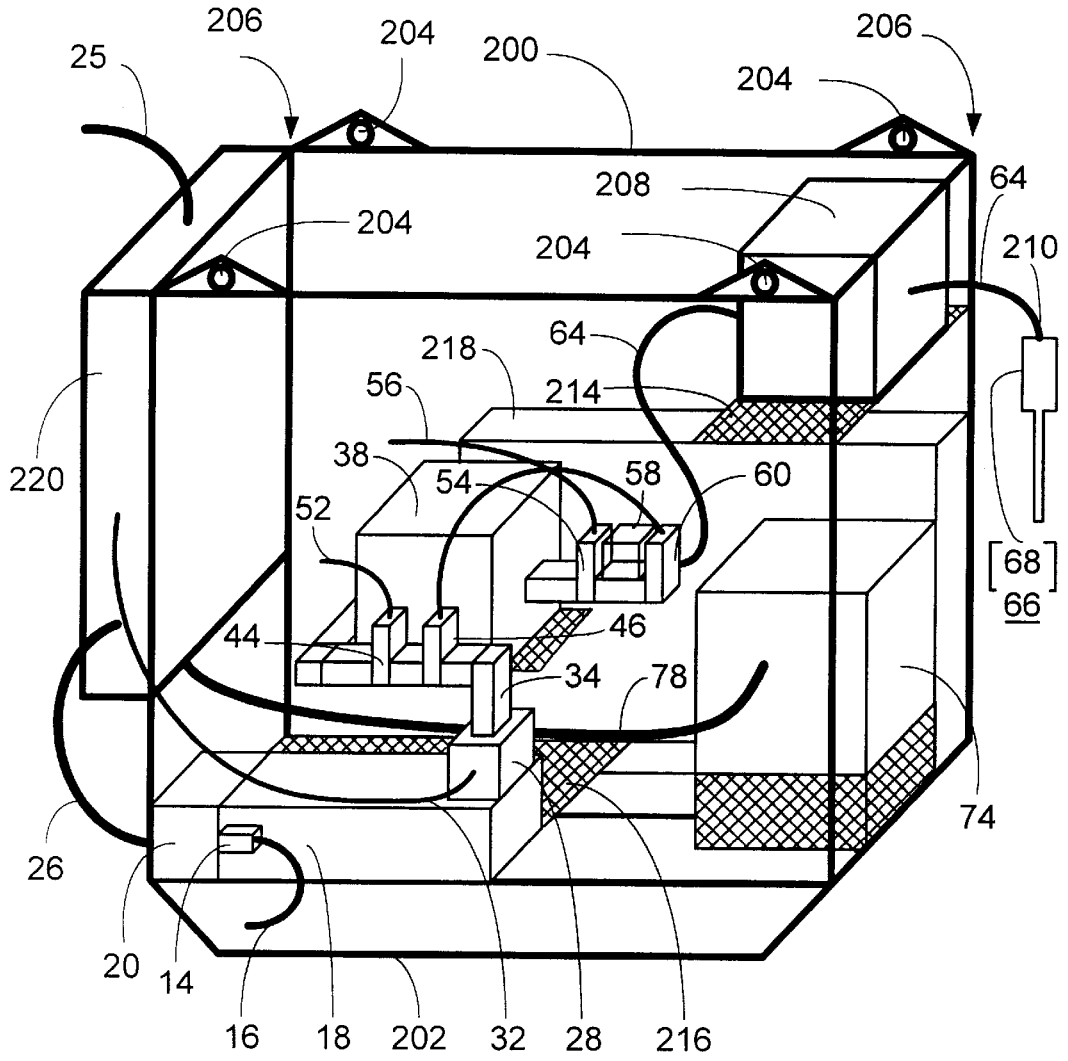
FIG. 2 is an perspective view of a cleaning unit of the present invention mounted on a skid assembly.

Referring now to FIG. 2, a perspective view of the unit 10 is shown housed within a skid structure 200. The structure generally includes skids 202 and lifting hooks 204 positioned at top corners 206 of the structure 200. Positioned within the structure 200 are the components described in FIG. 1. Additionally, the structure 200 includes a wand cable reel assembly 208 which has a desired amount of wand cable 64 connected at its distal end 210 to a wand 68. The reel assembly 208 is mounted on a plate 214. The structure all includes an oil plate 216 under the pump 38, a belt guard 218 covering the belt drive 76 connecting the motor 74 and the pump 38 and an electrical control unit box 220. The structure 200 and skids 202 are made of non-staining steel preferably stainless steel.

The structure and skids can be formed of any structural elements including L-beams and I-beams, but preferably, the structure and skids are made of stainless steel tubing $V_2$ to 1" in thickness. For off shore operation, the structure and skids all have rounded corners and no sharp edges. The hooks 204 are generally made out of stainless steel plating having a thickness of between about ½ to about 1". Of course, the exact form and layout of the structure 200 is a matter of convenience as is the material. For off-shore applications, the structure must be very durable and corrosion resistance to salt water and other corrosive environments.

Although the invention has been disclosed with reference to its preferred embodiments, from reading this description those of skill in the art may appreciate changes and modification that may be made which do not depart from the scope and spirit of the invention as described above and claimed hereafter.

What is claimed is:

1. An apparatus comprising:

a fluid heating unit including:

a fluid heating reservoir having:

a reservoir input connected to a fluid supply a reservoir output; and a heater having at least on heating element inserted into the reservoir for heating a fluid contained in the reservoir;

a pressurized, re-circulating pump assembly in fluid communication with the heating unit output including:

an oversized pump driven by an undersized motor where the pump comprises:

a low pressure side input including:

a re-circulation connection for receiving a re-circulation flow;

a high pressure side output including:

an unloader valve having:

an re-circulation outlet connected to the re-circulation connection of the low pressure input side where the re-circulation flow exist whenever a pressure at the unloader valve exceeds a re-circulation pressure; and a fluid outlet;

an output device connected to the unloader valve fluid outlet which supports a cleaning fluid flow rate whenever the output device is in an open condition; and an electrical control unit for supplying electrical energy to the heater and motors where the pump has a maximum capacity about 10 to 100% greater than a desired operating flow output and pressure of the system allowing for the motor to be undersized increasing apparatus lifetime.

2. The apparatus of claim 1, wherein the heating unit further including a temperature sensor for controlling a temperature of the fluid to a desired temperature where the sensor is in electrical communication with the electric control unit which turns on or off electric power to the heater depending on an output of the sensor.

3. The apparatus of claim 1, wherein the low pressure input further including a low pressure relief valve for venting fluid when a low pressure side fluid pressure exceeds a low pressure limit.

4. The apparatus of claim 1, wherein the high pressure side output further including a high pressure relief valve for venting fluid when a high pressure side fluid pressure exceeds a high pressure limit.

5. The apparatus of claim 1, wherein the high pressure side output further including an anti-hammer device for damping pressure oscillations when the unloader valve, re-circulation valve opens and closes.

6. The apparatus of claim 1, wherein the reservoir input is an one-way input and the reservoir is an one-way output.

7. A method for cleaning a surface comprising the step of:

directing a cleaning fluid flow onto a surface to be cleaned where the fluid flow is produced by an apparatus comprising:

a fluid heating unit including:

a fluid heating reservoir having:

a fluid input connected to a fluid supply;

a fluid output; and a heater having at least on heating element inserted into the reservoir for heating a fluid contained in the reservoir;

a pressurized, re-circulating pump assembly in fluid communication with the heating unit output including:

an oversized pump driven by an undersized motor where the pump comprises:

a low pressure side input including:

a re-circulation connection for receiving a re-circulation flow;

a high pressure side output including:

an unloader valve having:

an re-circulation outlet connected to the re-circulation connection of the low pressure input side where the re-circulation flow exist whenever a pressure at the unloader valve exceeds a re-circulation pressure; and a fluid outlet;

an output device connect the unloader valve fluid outlet which supports a cleaning fluid flow rate whenever the output device is in an open condition; and an electrical control unit for supplying electrical energy to the heater and motor, where the pump has a maximum capacity about 10 to 100% greater than a desired operating flow output and pressure allowing for the motor to be undersized increasing apparatus lifetime.

8. The method of claim 7, wherein the heating unit further including a temperature sensor for controlling a temperature of the fluid to a desired temperature where the sensor is in electrical communication with the electric control unit which turns on or off electric power to the heater depending on an output of the sensor.

9. The method of claim 7, wherein the low pressure input further including a low pressure relief valve for venting fluid when a low pressure side fluid pressure exceeds a low pressure limit.

10. The method of claim 7, wherein the high pressure side output further including a high pressure relief valve for venting fluid when a high pressure side fluid pressure exceeds a high pressure limit.

11. The method of claim 7, wherein the high pressure side output further including an anti-hammer device for damping pressure oscillations when the unloader valve, re-circulation valve opens and closes.

12. The method of claim 7, wherein the reservoir input is an one-way input and the reservoir is an one-way output.

13. A method for producing a fluid flow comprising the step of:

heating a fluid to a desired temperature in a fluid beating unit including:

a fluid heating reservoir comprising:

a fluid input connected to a fluid supply;

a fluid output; and a heater having at least on heating element inserted into the reservoir for heating a fluid contained in the reservoir;

forwarding the heated fluid to a pressurized re-circulating pump assembly comprising:

an oversized pump driven by an undersized motor where the pump comprises:

a low pressure side input including:

a re-circulation connection for receiving a re-circulation flow;

a high pressure side output including:

an unloader valve having:

an re-circulation outlet connected to the re-circulation connection of the low pressure input side; and a fluid outlet;

re-circulating the fluid from the re-circulating outlet of the unloader valve to the re-circulation connector of the low pressure input when a pressure at the unloader valve exceeds a re-circulation pressure;

forwarding a fluid flow to an output device connect the unloader valve fluid outlet which supports a cleaning fluid flow rate whenever the output device is in an open condition;

where an electrical control unit supplies electrical energy to the heater and motor and where the pump has a maximum capacity about 10 to 100% greater than a desired operating flow output and pressure allowing for the motor to be undersized increasing apparatus lifetime.

14. The method of claim 13, wherein the heating unit further including a temperature sensor for controlling a temperature of the fluid to a desired temperature where the sensor is in electrical communication with the electric control unit which turns on or off electric power to the heater depending on an output of the sensor.

15. The method of claim 13, wherein the low pressure input further including a low pressure relief valve for venting fluid when a low pressure side fluid pressure exceeds a low pressure limit.

16. The method of claim 13, wherein the high pressure side output further including a high pressure relief valve for venting fluid when a high pressure side fluid pressure exceeds a high pressure limit.

17. The method of claim 13, wherein the high pressure side output further including an anti-hammer device for damping pressure oscillations when the unloader valve, re-circulation valve opens and closes.

18. The method of claim 13, wherein the reservoir input is an one-way input and the reservoir is an one-way output.

* * * * *